United States Patent [19]

Hisamoto et al.

[11] 4,081,776

[45] Mar. 28, 1978

[54] TRANSFORMER WITH HEAT CONDUCTING LAMINATE

[75] Inventors: Hironori Hisamoto, Katano; Katsushi Muraki, Osaka; Motoji Kimura, Matsusaka, all of Japan

[73] Assignee: Matsushita Electric Industrial Co., Ltd., Osaka, Japan

[21] Appl. No.: 692,039

[22] Filed: Jun. 2, 1976

[30] Foreign Application Priority Data

Jun. 16, 1975 Japan ..... 50-73459

[51] Int. Cl.[2] ..... H01F 27/22

[52] U.S. Cl. ..... 336/61; 336/205; 336/206

[58] Field of Search ..... 336/205, 206, 55, 61

[56] References Cited

U.S. PATENT DOCUMENTS

| | | | |
|---|---|---|---|
| 2,361,249 | 10/1944 | Venable | 336/55 |
| 2,992,405 | 7/1961 | Ursch | 336/55 |
| 3,170,130 | 2/1965 | Begley | 336/55 |
| 3,428,928 | 2/1969 | Maines | 336/61 |
| 3,945,854 | 3/1976 | Alais | 136/211 X |
| 4,009,459 | 2/1977 | Benson et al. | 336/61 X |

*Primary Examiner*—Edward A. Miller

*Attorney, Agent, or Firm*—Burgess, Ryan and Wayne

[57] ABSTRACT

A transformer is disclosed in which an insulating material having a thermal conductivity higher than $10^{-3}$ cal/cm.sec.° C is interposed between a coil and a core so that transfer of heat generated in the coil to the core may be attained at a higher rate and consequently efficient heat dissipation may be effected. The diameters of conductors used may be reduced so that a transformer compact in size and light in weight may be provided.

3 Claims, 16 Drawing Figures

TRANSFORMER WITH HEAT CONDUCTING LAMINATE

BACKGROUND OF THE INVENTION

The present invention relates to a transformer used in electrical equipment such as a microwave oven, a television receiver or the like and provided with an insulating material having a thermal conductivity higher than $10^{-3}$ cal/cm.sec.° C which insulating material is interposed between a coil and a core.

There have been devised and demonstrated various types of transformers. In the shell-type transformers in which a coil or winding consisting of conductors wound around a bobbin and insulated with special insulating covering paper is placed on the central leg of the core consisting of E- and I-type or only E-type laminates stacked, insulating paper sheets are placed between the core and the upper and lower ends of the coil. The bobbin is mainly made of polyamide or a phenolic resin, and the covering and insulating paper, polyethylene terephthalate or aramid. However, they have, in general, a considerably low thermal conductivity. In addition, even when insulating members are placed between the core and the coil, there still remain air gaps therebetween, because it is almost impossible to attain very intimate contact between the core and the coil.

Since there exist insulating members and air with a lower thermal conductivity between the core and the coil, thermal resistance is quite high in the prior art transformers. As a result, the quick transfer of heat generated in the coil to the core cannot be attained, resulting in a considerable temperature rise of the coil. One method for overcoming this problem is to use conductors with a relatively large diameter and hence with a relatively low resistance so that the generation of Joule heat may be minimized. However, when conductors with a greater diameter are selected, the coil becomes large in size so that the core must also be made large in size. Therefore the consumption of copper and iron is increased with the resultant increase in manufacturing cost. This is a waste of precious natural resources, and it is the social responsibility placed on every manufacturer to make full use of scarce and precious natural resources.

SUMMARY OF THE INVENTION

In view of the above, one of the objects of the present invention is to provide a transformer in which Joule heat generated in a coil may be rapidly transferred to a core and may be efficiently dissipated therefrom.

Another object of the present invention is to improve the heat dissipation characteristic of a transformer so that conductors with a smaller diameter may be used and consequently a coil may be made compact in size.

A further object of the present invention is to make a core of a transformer compact in size by making a coil compact in size, thereby providing the transformer compact in size and light in weight.

A further object of the present invention is to provide a transformer compact in size and light in weight so that savings in materials such as copper and iron may be attained, full use of scarce raw materials can be attained and consequently manufacturing cost may be considerably reduced.

Figure 1:
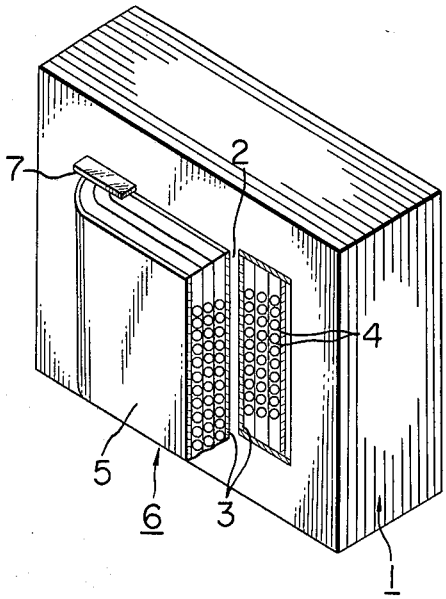
FIG. 1 PRIOR ART
FIGS. 1, 2 and 3 are perspective views, partly in section, of prior art transformers.

DESCRIPTION OF THE PREFERRED EMBODIMENTS:

Prior Art, FIGS. 1 through 4

Prior to the description of the preferred embodiments of the present invention, some of the prior art transformers will be briefly described. In a prior art transformer of the type shown in FIG. 1, a shell type core 1 consists of E- and I-type laminations or only E-type laminations interleaved with each other, and a coil or winding 6 which is placed on the center leg of the core 1 consists of turns of conductors 4 wound around a bobbin 3 and insulated with a paper covering 5. The coil or winding 6 is insulated from the core 1 with the paper covering 5 and insulating paper 7 placed between the core 1 and the end surfaces of the coil or winding 6. The transformer thus assembled is impregnated with varnish or the like.

Figure 2:
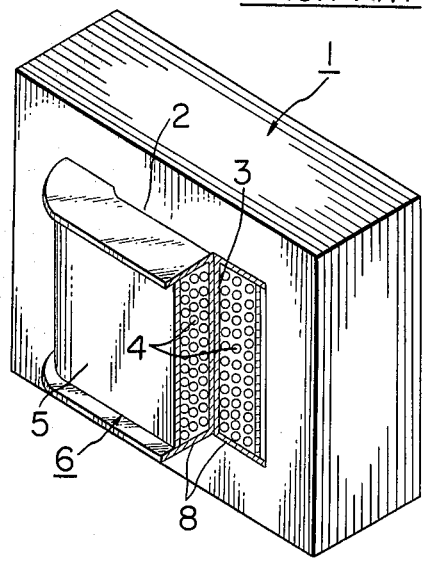
FIG. 2 PRIOR ART

In a transformer of the type shown in FIG. 2, the bobbin 3 has flanges 8 so that the insulating paper 7 may be eliminated.

Figure 3:
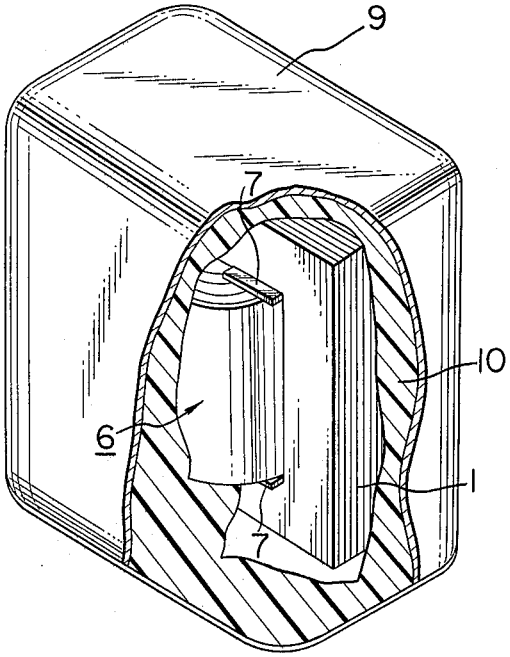
FIG. 3 PRIOR ART

In a transformer of the type shown in FIG. 3, it is placed in a case 9 which is filled with insulating liquid such as asphalt or synthetic resin.

The bobbins 3 are made of polyamide or phenolic plastics, the covering paper 5, and insulating paper 7 polyethylene terephthalate or aramid, and the filling compound 10 consists of polyester.

Figure 4:
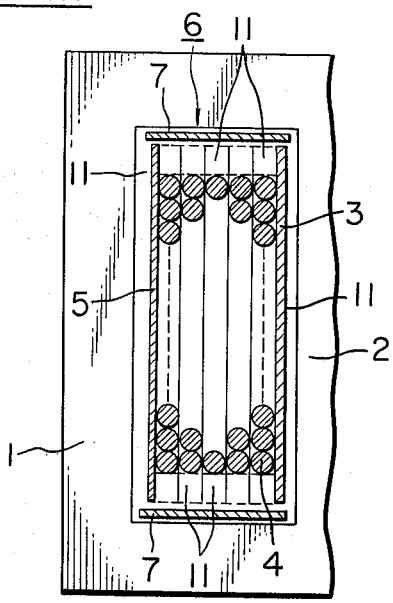
FIG. 4 PRIOR ART
FIG. 4 is a fragmentary sectional view of a further prior art transformer.

In the transformers of the types shown in FIGS. 1 and 2, even when the bobbin 3, the insulating covering 5 and the insulating paper 7 are used, they cannot be placed in intimate contact with the coil or winding 6 and core 1 so that gaps 11 result as shown in FIG. 4.

Thermal conductivities of the materials used in the above transformers and air are shown in Table 1 below, and it is seen that the difference in thermal conductivity between copper and iron is considerably great.

Table 1

| Materials | Thermal conductivity (cal/cm . sec. ° C) |
|---|---|
| Polyethylene terephthalate | $3.6 \times 10^{-4}$ |
| Aramid paper | $0.81 \times 10^{-4}$ |
| Polyamide resin (nylon) | $5.8 \times 10^{-4}$ |

Table 1-continued

| Materials | Thermal conductivity (cal/cm . sec. ° C) |
|---|---|
| Polyester resin | $4.0 \times 10^{-4}$ |
| Phenol resin | $3$ to $6 \times 10^{-4}$ |
| Air | $0.6 \times 10^{-4}$ (at 20° C) |
| Copper | $9.2 \times 10^{-1}$ |
| Iron | $1.7 \times 10^{-1}$ |

Therefore the air gap or insulating material with a low thermal conductivity between the core 1 and the coil or winding 6 results in the increase in thermal resistance so that the rapid transfer of the heat generated in the coil or winding 6 to the core 1 is adversely affected and consequently the excessive temperature rise of the coil or winding 6 results.

To overcome this problem, the conductors 4 with a large diameter must be selected to reduce the electrical resistance thereof, thereby minimizing the generation of Joule heat. This arrangement results in an increase in the size of the coil or winding 6 and hence the core 1. As a result, the transformer becomes large in size with the increase in quantity of iron or steel which is the material for laminations of the core 1 and copper which is the material for conductors 4. Therefore the cost becomes expensive, and precious natural resources are wasted. These are serious problems in view of social responsibility.

First Embodiment, FIGS. 5 through 10

Figure 5:
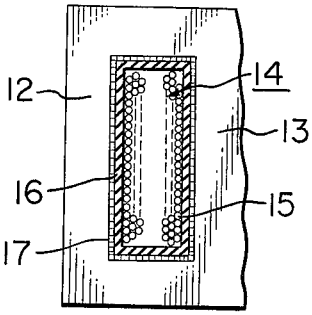
FIG. 5 is a fragmentary sectional view of a transformer in accordance with the present invention illustrating the fundamental construction thereof.
Figure 6:
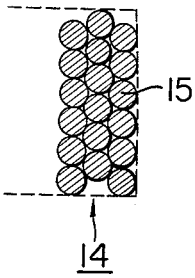
FIG. 6 is a fragmentary sectional view of a coil thereof.

In FIGS. 5 and 6, there is shown the fundamental construction of a transformer in accordance with the present invention. A coil or winding 14 is placed on a central leg 13 of a core 12 consisting of E- and I-type laminates or E-type laminates which are stacked one over another. As shown in FIG. 6, the coil or winding 14 preferably consists of a multi-layer of conductors 15 without the use of a bobbin and insulating paper placed between the layers. However, it suffices to wind the conductors 15 very closely. It is preferable to use conductors 15 applied with thermoplastic paint and to impregnate the coil or winding 14 with varnish or the like so that it may be assembled as a unitary construction.

According to the present invention, an insulating material having a high thermal conductivity is interposed between the coil or winding 14 and the core 12 so that the heat which is generated in the coil or winding 14 may be transfered to the core 12 and dissipated in an efficient manner.

That is, a sintered ceramic body 16 made of alumina or mullite having a thermal conductivity higher than $10^{-3}$ cal/cm.sec.° C is placed in intimate contact with the outer surfaces of the coil or winding 14, and an adhesive or resilient member 17 having a thermal conductivity higher than $10^{-3}$ cal/cm.sec.° C is placed between the ceramic body 16 and the core 12. Thereafter, the assembly is impregnated with varnish or wax.

The thermal conductivities of alumina and mullite are $5 \times 10^{-3}$ cal/cm.sec.° C and $60 \times 10^{-3}$ cal/cm.sec.° C, respectively. Other kinds of ceramic bodies have a thermal conductivity of the order of $10^{-2}$ to $10^{-3}$ cal/cm.sec.° C. Therefore the ceramic bodies have an excellent thermal conductivity which is 10 to 100 times those of the conventional organic insulating materials. As the adhesive or resilient member 17, silicone rubber may be used which is an insulating material having a thermal conductivity higher than $10^{-3}$ cal/cm.sec.° C. The heat generated in the coil or winding 14 is therefore transferred immediately to the core 12 and dissipated therefrom.

Next some preferred embodiments of the present invention will be described with reference to FIGS. 7, 8, 9 and 10. In the transformer shown in FIG. 7, a sintered ceramic body 20 rectangular in cross section is fitted over a central leg 19 of an E-type core 18 consisting of E-type laminates. The inner surfaces of the sintered ceramic body 20 is lined with an adhesive or resilient layer 21.

A coil or winding 22 which is formed in the manner described above is placed over the sintered ceramic body 20, and sintered ceramic bodies 25 and 26 both U-shaped in cross sections are placed over outer legs 23 and 24, respectively, of the E-type core 18. The outer surfaces of the sintered ceramic bodies 25 and 26 are lined with adhesive or resilient layers 27 and 28, respectively.

An I-type core 29 consisting of I-type laminates is placed over the open end or free ends of the legs of the E-type core 18. The assembled transformer is further impregnated with wax or varnish in a conventional manner.

Figure 8:
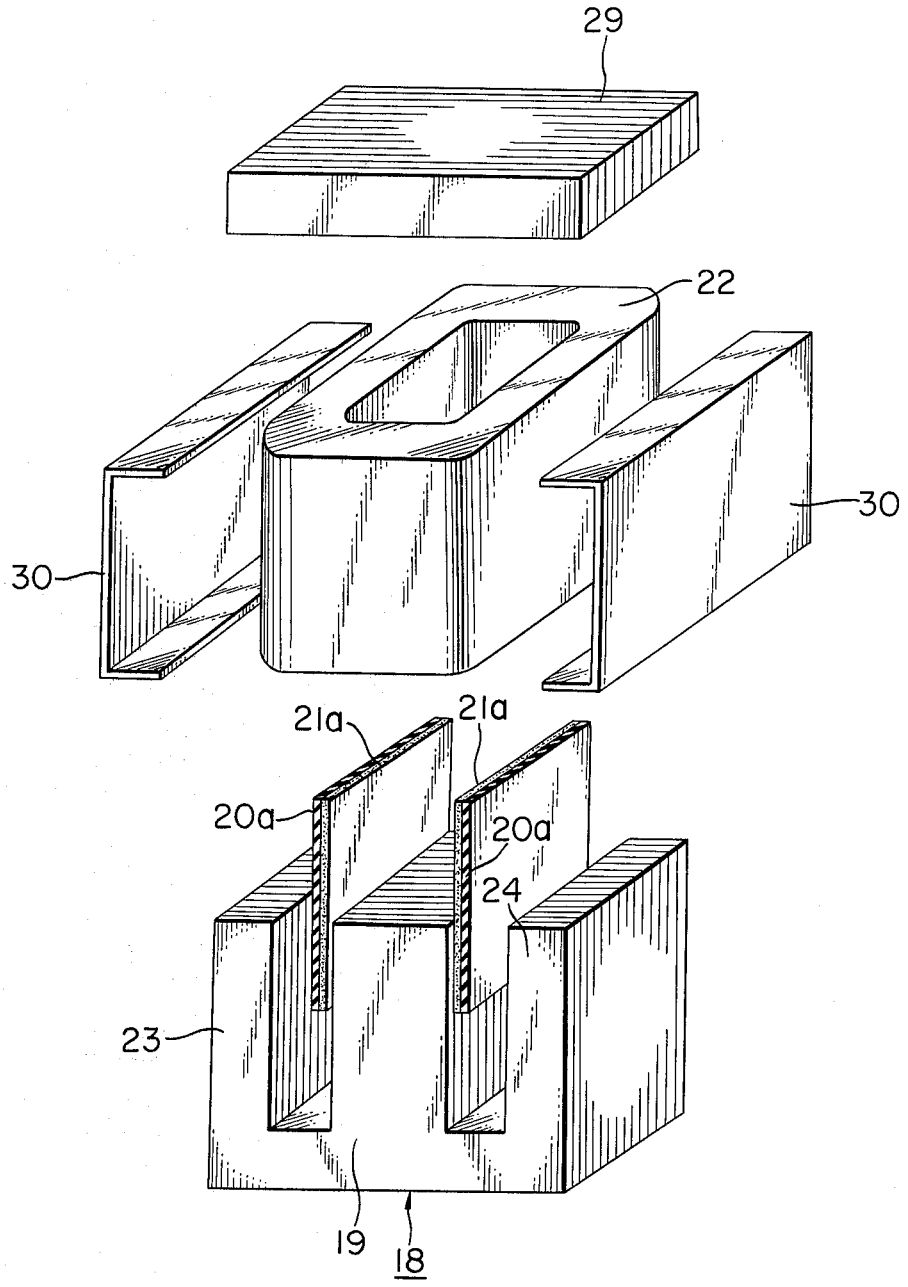

In the transformer shown in FIG. 8, two sintered ceramic plates **20*a* each having its inner surface lined with an adhesive or resilient layer 21*a* are placed over the major or side surfaces of the central leg 19 of the E-type core 18, and insulators 30 U-shaped in cross section and made of organic materials are placed between the inner surfaces of the outer legs 23 and 24 and the coil or winding 22**.

With this construction, the most effective thermal conduction from the coil or winding 22 to the core 18 is effected through the sintered ceramic plates **20*a* placed between the central leg 19 and the coil or winding 22. As a result, the heat dissipation characteristic is somewhat inferior to that of the transformer shown in FIG. 7**, but is far superior to those of the prior art transformers.

Figure 7:
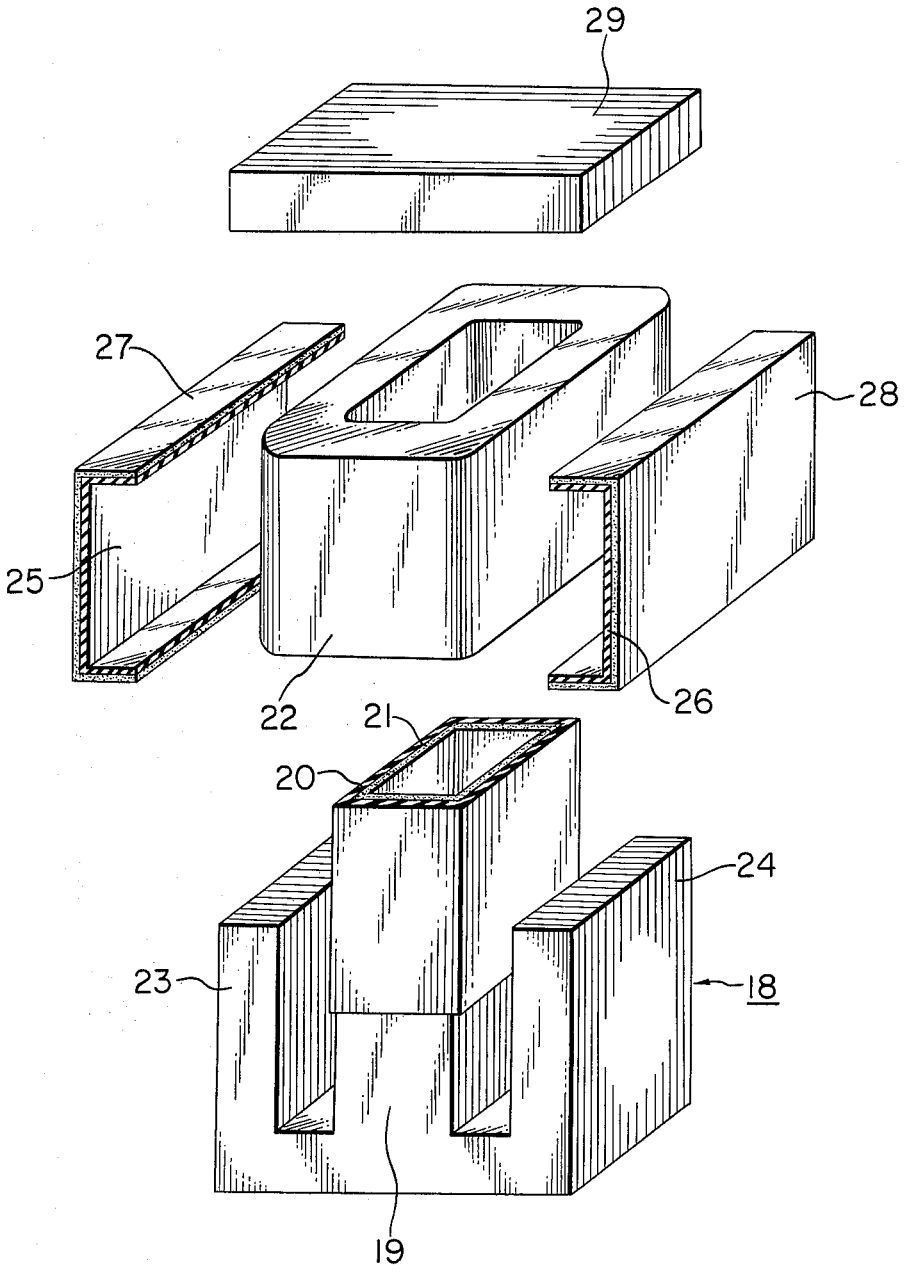
FIGS. 7 through 10 are exploded perspective views of first embodiments of a transformer in accordance with the present invention.
Figure 9:
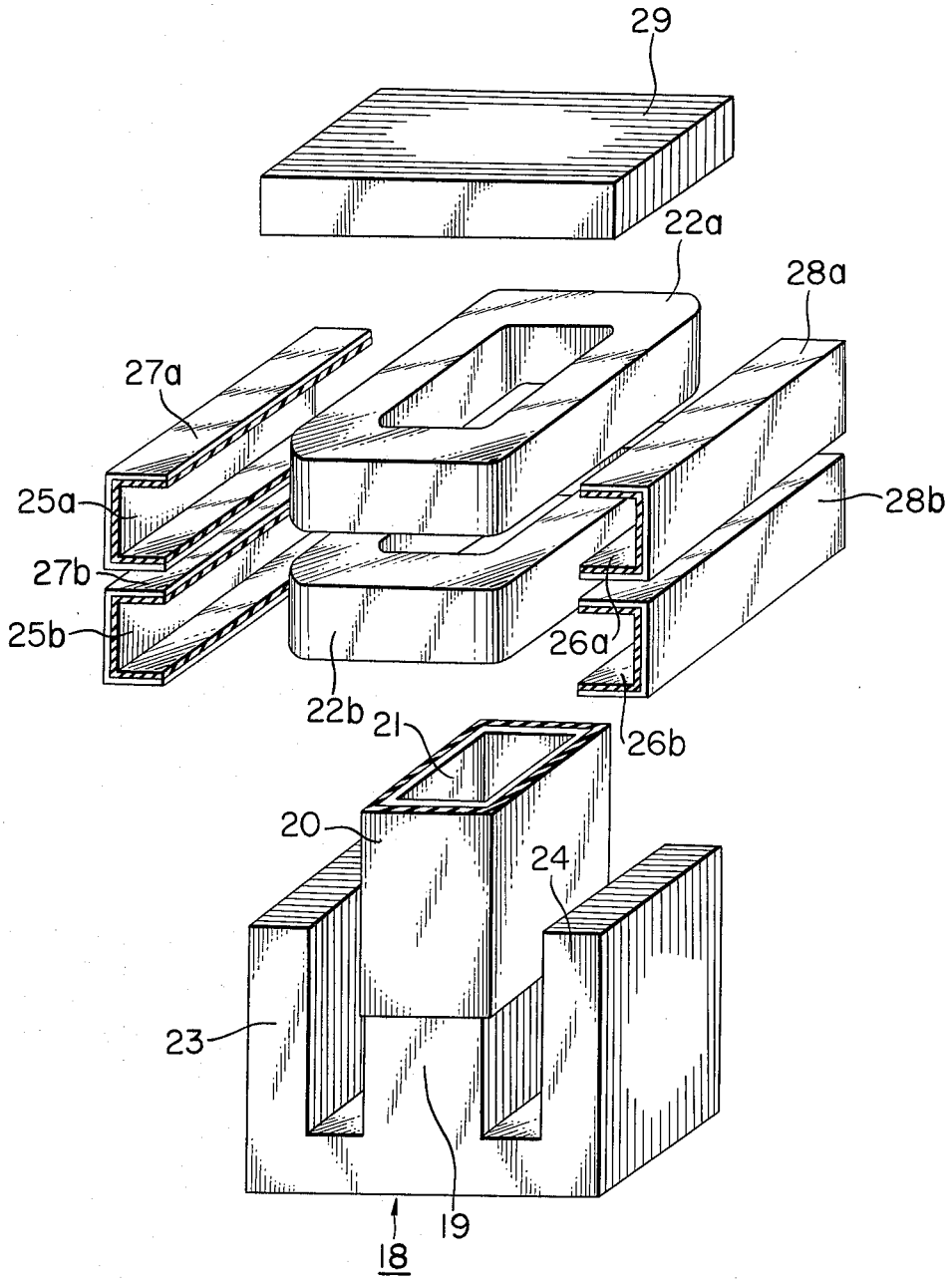

The transformer shown in FIG. 9 is substantially similar in construction to the transformer shown in FIG. 7 except that it has two coils or windings **22*a* and 22*b*. U-shaped sintered ceramic bodies 25*a*, 25*b*, 26*a* and 26*b* having the outer surfaces lined with adhesive or resilient layers 27*a*, 27*b*, 28*a* and 28*b*, respectively, are fitted over the coils or windings 22*a* and 22*b***.

The characteristic feature common to the transformers described above with reference to FIGS. 7, 8, 9 and 10 resides in the fact that at least one sintered ceramic body having a thermal conductivity higher than $10^{-3}$ cal/cm.sec.° C and having one major surface thereof lined with an adhesive or resilient layer is interposed between the coil or winding and the core.

Table 2 below shows the specifications and thermal characteristics of the leakage-flux type transformer shown in FIG. 10 and a prior art transformer.

Table 2

| | Prior Art | | Invention | | Methods for measuring |
|---|---|---|---|---|---|
| | Specifications | Temperature rise, ° C | Specifications | Temperature rise, ° C | temperature rise |
| Primary | 1.7 mm in dia. | 112° C | 1.5 mm in dia. | 98° C | resistance |

Table 2-continued

Figure 10:
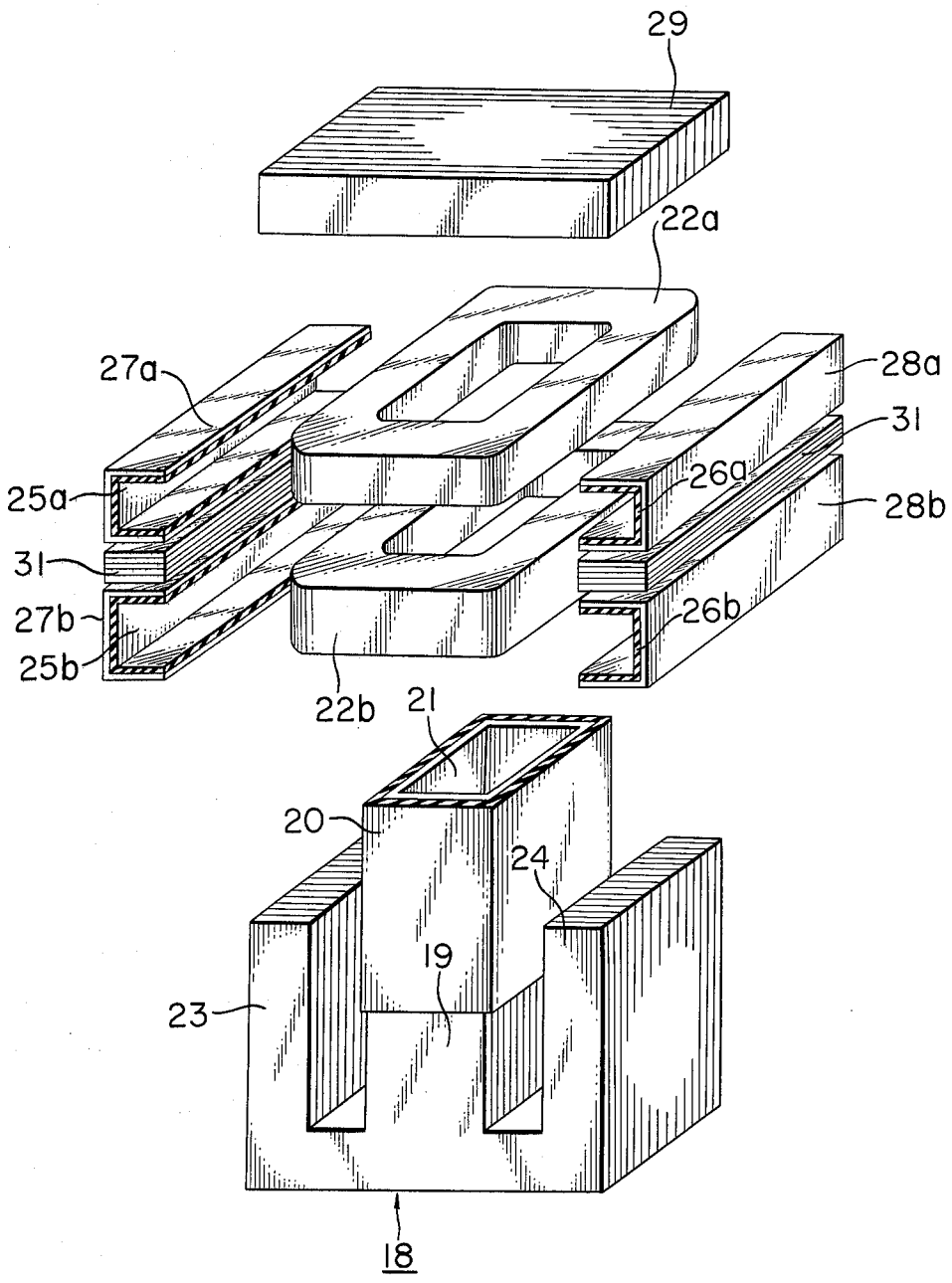
Figure 11:
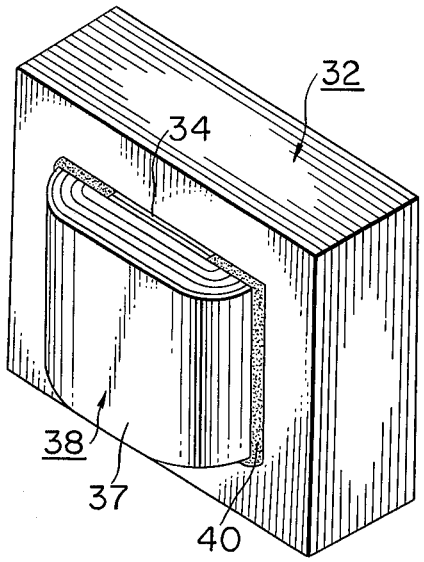
FIG. 11 is a perspective view of a second embodiment of the present invention.
Figure 12:
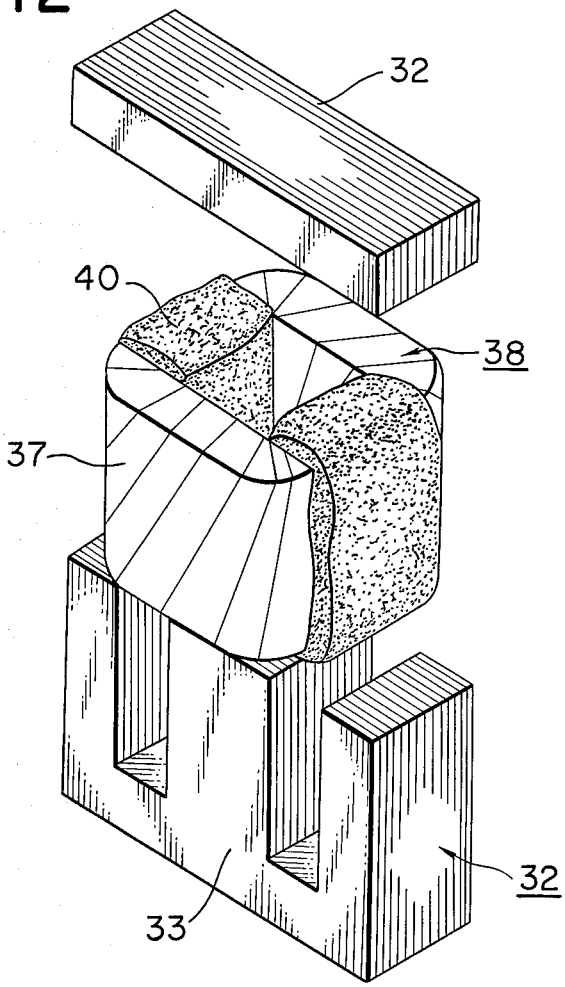
FIG. 12 is an exploded perspective view thereof.
Figure 13:
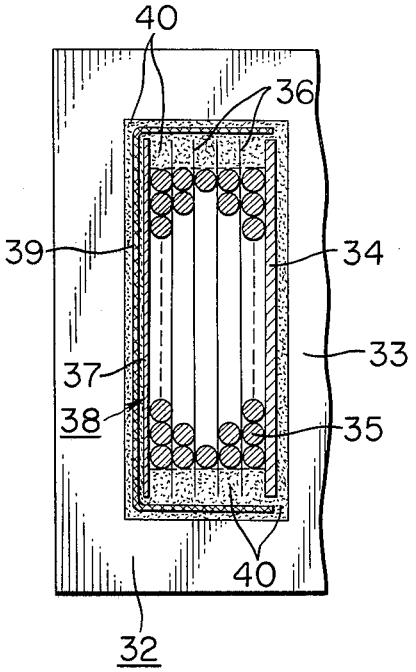
FIG. 13 is a fragmentary sectional view thereof.

| | Prior Art | | Invention | | Methods for measuring |
|---|---|---|---|---|---|
| | Specifications | Temperature rise, ° C | Specifications | Temperature rise, ° C | temperature rise |
| | | | | | method |
| Secondary | 0.46 mm in dia. | 134° C | 0.4 mm in dia. | 115° C | " |
| Core | 120 × 99 mm | 73° C | 114 × 95 mm | 88.5° C | thermocouple |
| Insulators | Organic materials | | As shown in FIG. 10 | | |
| Total weight | 7.5 kg. | | 6.6 kg. | | |
| Outer dimensions | 120 × 99 × 130 mm | | 114 × 95 × 125 mm | | |

Instead of the sintered ceramic bodies and the adhesive or resilient layers or members, a mixture consisting of, as a major constituent, inorganic compound powder and a filling compound having a thermal conductivity higher than $10^{-3}$ cal/cm.sec.° C may be used. The ceramic bodies may have a thickness greater than the thickness of the laminated core in order to improve the insulation between the coil or winding and the core. Furthermore the surfaces of the sintered ceramic bodies may be finished rough so that secure bonding may be obtained between them on the one hand and the core and coil or windings on the other hand. Alternatively, instead of the adhesive or resilient layers, sheets made of suitable cloth applied with semi-liquid resin or plastic may be interposed between the ceramic body and the core or coil and then heated to be hardened to secure the close bonding between them.

As described above, according to the present invention the heat generated in the coil or winding is rapidly transmitted or conducted to the core and dissipated so that the temperature rise may be minimized. Therefore conductors with a fine diameter may be used so that the coil or winding may be made compact in size. Consequently, the transformer itself can be made considerably compact in size. Materials such as iron and copper used may be saved, and therefore the more effective use of natural resources becomes possible. Thus the present invention is very useful in industry.

Second Embodiment, FIGS. 11 through 14

In FIGS. 11 through 14, there is shown the second embodiment of a shell type transformer in accordance with the present invention. A coil or winding 38 is placed on a central leg 33 of a core 32 consisting of E- and I-type laminates. The coil or winding 38 consists of copper conductors 35 wound around a bobbin 34, and each layer of conductors 35 is insulated from the adjacent layers with insulating paper 36. The coil or winding 37 is insulated with a covering paper 37.

Between the core 32 and the coil or winding 38 is interposed an insulating cloth 39 consisting of polyester or glass cloth or unwoven cloth impregnated with an impregnating compound 40 having a thermal conductivity higher than $10^{-3}$ cal/cm.sec.° C. The impregnating compound is also filled into the bobbin 34.

One example of the compositions of the impregnating and filling compounds is shown in Table 3 below.

Table 3

| constituents | % by weight |
|---|---|
| diluted hardener | 0.2 |
| xylole | 17.6 |
| varnish | 2.0 |
| aerosil | 0.8 |
| crystallite (60 to 100 mesh) | 39.8 |
| crystallite (less than 19 μ) | 39.7 |

After the impregnating and filling compound 40 has been hardened, the transformer is further impregnated with wax or varnish.

The cloth 39 is used in order to prevent the flow and deformation of the impregnating compound 40 when the latter is applied. The cloth 39 also serves to retain the hardened impregnating compound 40 in intimate contact with both the core 32 and the coil or winding 38. In general, the hardened impregnating and filling compound 40 is brittle so that it is easily susceptible to cracking and fracture under mechanical shocks. Therefore the cloth 39 is used as reinforcing means in order to increase the mechanical strength of the impregnating compound 40. The cloth or base 39 may be suitably selected depending upon the desired temperature characteristics of the transformer. The cloth sheet or base 39 is, for instance, cotton, polyester or glass woven cloth or unwoven cloth having a large number of voids or pores and having mechanical strength greater than the impregnating compound 40 has. Since the cloth or base 39 is not used for the purpose of insulation, its thickness may be made as practically thin as possible.

However, when the impregnating compound 40 has desired adhesivity, viscosity, mechanical strength when hardened and so on which may satisfy the requirements of the transformer, the cloth sheet or base 39 may be eliminated.

Figure 14:
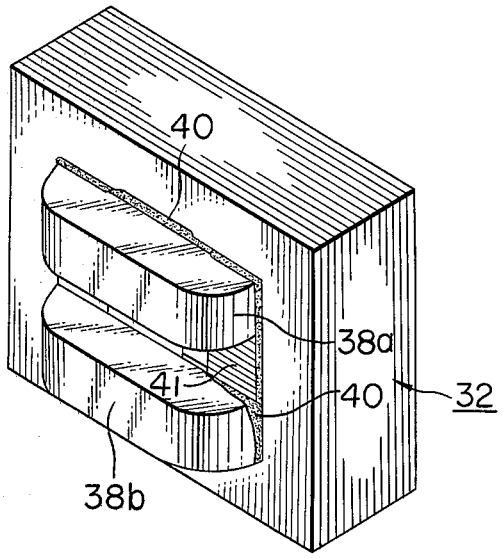
FIG. 14 is a perspective view of a modification of the second embodiment.

The transformer having a primary coil **38*a* and a secondary coil 38*b* and a shunt core 41 therebetween as shown in FIG. 14 may be constructed in a manner substantially similar to that described above with reference to FIGS. 11, 12 and 13**.

Table 4 below shows the comparison between the prior art H type power transformer using glass tapes, aramid paper and varnish and the H type power transformer in accordance with the present invention using the impregnating compound of the type shown in Table 3 and aramid paper and varnish.

Table 4

| | Prior Art | | Invention | | Methods for measuring |
|---|---|---|---|---|---|
| | Specifications | Temperature rise, ° C | Specifications | Temperature rise, ° C | temperature rise |
| Primary | 1.7 mm in dia. | 112° C | 1.5 mm in dia. | 120° C | resistance method |

Table 4-continued

| | Prior Art | | Invention | | Methods for measuring |
|---|---|---|---|---|---|
| | Specifications | Temperature rise, ° C | Specifications | Temperature rise, ° C | temperature rise |
| Secondary | 0.45 mm in dia. | 134° C | 0.4 mm in dia. | 115° C | " |
| Core | 120 × 99 mm | 73° C | 114 × 95 mm | 89.5° C | thermocouple |
| Impregnating compound | None | | The composition is shown in Table 3 | | |
| Total weight | 7.5 kg. | | 6.6 kg. | | |
| Outer dimensions | 120 × 99 × 130 mm | | 114 × 95 × 125 mm | | |

It is seen from Table 4 that as compared with the prior art transformers the diameters of the conductors of the transformer in accordance with the present invention may be reduced by 11 to 12%; the outer dimensions, by about 12%; and the weight, by 12%.

Table 5 shows the thermal resistances of the same transformers.

Table 5

| | Prior Art | Invention |
|---|---|---|
| between primary and core | 1.3 | 0.56 |
| between secondary and core | 1.3 | 0.53 |

The powder of an inorganic compound such as silica, calcium carbonate or the like which is a major constituent of the impregnating compound 40 is considerably inexpensive as compared with synthetic resins or plastics such as epoxy, polyester or the like.

Since the volume of the impregnating compound 40 is less and its shrinkage is very small, it will not damage the coil or winding 38. In addition, the thickness of the impregnating compound 40 is less so that no cracking will occur.

In case of the coil or winding 38 in which the conductors layers are insulated from each other with insulating paper 36, the filling and impregnating compound 40 may be filled under some pressure into the bobbin so that it may be made into very intimate contact with both the conductors 35 and the core 32 and consequently there exists no void or pore in the coil or winding 38. Therefore the abnormal vibrations of the coil or winding 38 as well as the generation of abnormal noise may be prevented.

As described above, according to the second embodiment of the present invention the heat generated in the coil or winding can be immediately transferred through the impregnating and filling compound to the core and dissipated from the core so that the temperature rise of the coil or winding may be minimized. Therefore the conductors with a small diameter may be used and consequently the core may be also made compact in size. As a result, the transformer which is compact in size and light in weight may be provided. The quantity of copper and iron used may be minimized so that the effective use of natural resources may be realized and the manufacturing cost may be reduced. Thus it is possible to completely fulfil social responsibility for conserving energy and scarce raw materials. The present invention is therefore very useful in industry.

Figure 15:
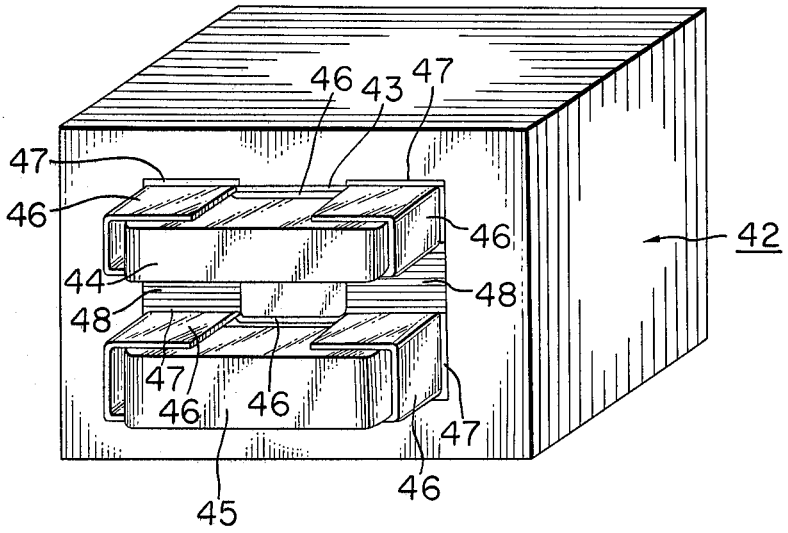
FIG. 15 is a perspective view of a third embodiment of the present invention.
Figure 16:
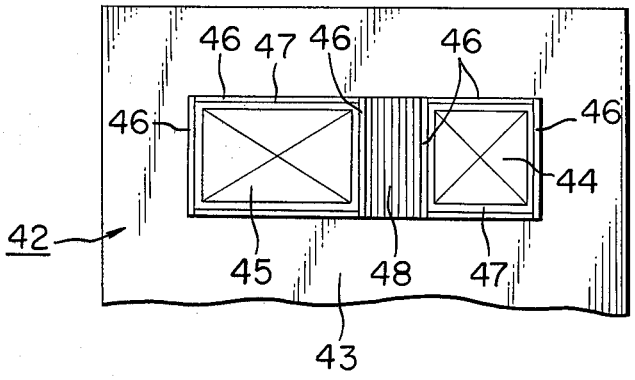
FIG. 16 is a fragmentary sectional view thereof.

Third Embodiment, FIGS. 15 and 16

In FIGS. 15 and 16 there is shown the third embodiment of the present invention. The transformer shown is of the shell-type, and a primary coil or winding 44 and a secondary coil or winding 45 are placed on a central leg 43 of a core 42 consisting of E- and I-type laminates. As with the case of the transformer shown in FIG. 10, the primary and secondary coils or windings 44 and 45 are fitted with ceramic bodies 46 having a high thermal conductivity higher than $10^{-2}$ to $10^{-3}$ cal/cm.sec.° C, and are bonded thereto with adhesive 47. Shunt cores 48 are placed between the primary and secondary coils or windings 44 and 45. The ceramic bodies 46 have a length longer than the core 42 by five to 10 mm so that they may be fitted over the coils or windings 44 and 45 extended out of the core 42.

Since the ceramic bodies 46 having a higher thermal conductivity are placed between the primary 44 and the secondary 45 and the core 42, the thermal resistance may be reduced considerably as compared with the prior art transformers. The heat produced in the primary 44 and the secondary 45 can be positively transferred to the core 42 whose temperature rise ratio is lower. As a result, the average temperature rise in both the coils or windings 44 and 45 may be minimized.

Therefore when a transformer is to be constructed with the conductors having the same diameter with that of the conductors used in the prior art transformers, the insulating materials with less resistance to heat may be used. On the other hand, when the insulating materials having the same resistance to heat with that of the materials used in the prior art transformers, the diameters of the conductors may be reduced so that the transformer compact in size and light in weight may be provided.

For instance, in the transformer in accordance with the present invention in which the sectional areas of the primary and secondary conductors were reduced by 30% as compared with the prior art transformers, the average temperature rise of the coils or windings was lower than that of the prior art transformers.

In addition, as compared with the prior art transformers, the weight may be reduced by about 12%, and the consumption of copper and iron, by 10 to 12%.

Since the ceramic bodies 46 and fitted over the coils or windings 44 and 45 even at the portions thereof extended out of the core 42, they may serve as insulating means even when the insulation covering is broken or fractured, whereby the coils 44 and 45 and the core 42 may be protected from being damaged by the failure of insulation therebetween.

In summary, the ceramic bodies 46 has a double function of improving the dissipation of heat and insulating between the coils 44 and 45 and the core 42.

What is claimed is:

1. A transformer comprising a coil on a core and a lamination consisting of a sintered ceramic body which is made of alumina or mullite having a thermal conductivity higher than $10^{-3}$ cal/cm.sec.° C and an adhesive or resilient layer made of silicone rubber having a thermal conductivity higher than $10^{-3}$, cal/cm.sec.° C interposed between said coil and said core.

2. A transformer as set forth in claim 1 wherein the surfaces of said sintered ceramic body are finished with a rough surface.

3. A transformer as set forth in claim 1 wherein said ceramic body extends outwardly from said core in both directions.

* * * * *

UNITED STATES PATENT OFFICE
CERTIFICATE OF CORRECTION

Patent No. 4,081,776 Dated March 28, 1978

Inventor(s) Hironori Hisamoto, et al

It is certified that error appears in the above-identified patent and that said Letters Patent are hereby corrected as shown below:

Column 3, line 11: "the" should be --an--.

line 47: "transfered" should be --transferred--.

Column 7, line 61: "fufil" should be --fulfill--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*